US007380839B2

(12) United States Patent
Ellington et al.

(10) Patent No.: US 7,380,839 B2
(45) Date of Patent: Jun. 3, 2008

(54) SEALING EXPANDABLE TUBING

(75) Inventors: Peter Ellington, Aberdeen (GB); Simon John Harrall, Houston, TX (US); Paul David Metcalfe, Banchory (GB); Iain Cameron MacAulay, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 31 days.

(21) Appl. No.: 10/897,328

(22) Filed: Jul. 22, 2004

(65) Prior Publication Data

US 2005/0127672 A1 Jun. 16, 2005

(30) Foreign Application Priority Data

Jul. 25, 2003 (GB) ..... 0317395.2

(51) Int. Cl.
*F16L 15/00* (2006.01)
*F16L 13/14* (2006.01)

(52) U.S. Cl. ..... 285/333; 285/334; 285/355; 285/382.1; 285/382.2; 285/382.4

(58) Field of Classification Search ..... 285/333, 285/334, 355, 390, 382, 382.1, 382.2, 382.4, 285/382.5
See application file for complete search history.

(56) References Cited

U.S. PATENT DOCUMENTS

| | | | | |
|---|---|---|---|---|
| 2,160,263 | A * | 5/1939 | Fletcher | 285/115 |
| 4,530,527 | A * | 7/1985 | Holmberg | 285/382.4 |
| 4,705,307 | A * | 11/1987 | Chelette | 285/332.3 |
| 4,706,997 | A * | 11/1987 | Carstensen | 285/13 |
| 4,707,001 | A * | 11/1987 | Johnson | 285/332.3 |
| 4,893,844 | A * | 1/1990 | Chelette et al. | 285/113 |
| 5,029,906 | A * | 7/1991 | Chelette et al. | 285/113 |
| 6,409,175 | B1 | 6/2002 | Evans et al. | |
| 6,554,287 | B1 * | 4/2003 | Sivley et al. | 277/616 |
| 6,607,220 | B2 | 8/2003 | Sivley, IV | |
| 6,745,845 | B2 * | 6/2004 | Cook et al. | 166/387 |
| 6,971,685 | B2 * | 12/2005 | Hashem | 285/333 |
| 2002/0158469 | A1 * | 10/2002 | Mannella et al. | 285/333 |
| 2002/0163192 | A1 * | 11/2002 | Coulon et al. | 285/331 |
| 2003/0107213 | A1 * | 6/2003 | Baugh et al. | 285/92 |

(Continued)

FOREIGN PATENT DOCUMENTS

| | | |
|---|---|---|
| EP | 1 106 778 | 6/2001 |

(Continued)

OTHER PUBLICATIONS

GB Search Report dated Nov. 6, 2003 from GB Application No. 0317395.2.

(Continued)

*Primary Examiner*—James M. Hewitt
(74) *Attorney, Agent, or Firm*—Patterson & Sheridan, L.L.P.

(57) ABSTRACT

Expandable tubing and methods seal a connection between expandable tubulars, and in particular, seal a connection between expandable tubulars post-expansion. In one embodiment, a method includes sealing a connection between expandable tubulars in the form of sections of an expandable liner. The method comprises the steps of connecting a first expandable tubular in the form of a first section of the liner and a second expandable tubular in the form of a second section of the liner. A seal is located between radially overlapping portions of the liner sections, and the seal is configured to maintain sealing between the liner sections both pre and post expansion.

51 Claims, 6 Drawing Sheets

U.S. PATENT DOCUMENTS

2003/0107217 A1* 6/2003 Daigle et al. ..... 285/355
2003/0234538 A1* 12/2003 Hashem ..... 285/333
2004/0084901 A1* 5/2004 Church ..... 285/333
2004/0090068 A1* 5/2004 Evans et al. ..... 285/382
2005/0087983 A1* 4/2005 Verger et al. ..... 285/333
2005/0127673 A1* 6/2005 Simpson et al. ..... 285/382.4
2005/0212290 A1* 9/2005 Durand et al. ..... 285/333
2005/0236834 A1* 10/2005 Curley et al. ..... 285/333
2006/0006647 A1* 1/2006 Hashem et al. ..... 285/333
2006/0061099 A1* 3/2006 Evans et al. ..... 285/334

FOREIGN PATENT DOCUMENTS

GB 2 356 651 5/2001
GB 2393467 A * 3/2004

OTHER PUBLICATIONS

GB Search Report dated Aug. 9, 2004 from GB Application No. 0416426.5.

* cited by examiner

SEALING EXPANDABLE TUBING

CROSS-REFERENCE TO RELATED APPLICATIONS

This application claims benefit of Great Britain patent application serial number 0317395.2, filed Jul. 25, 2003, which is herein incorporated by reference.

BACKGROUND OF THE INVENTION

1. Field of the Invention

The present invention relates to expandable tubing and methods of sealing a connection between expandable tubulars. In particular, but not exclusively, the present invention relates to methods of sealing a connection between expandable tubulars post-expansion.

2. Description of the Related Art

In the oil and gas exploration and production industry, there has been much research into the development of expandable tubulars in recent years. A number of different types of expandable tubing have been developed, including expandable sand-exclusion tubing based assemblies and solid expandable tubing such as expandable casing, liner, patches and straddles.

The tubing is typically expanded using either an expansion cone or mandrel, or a roller expansion tool, such as that disclosed in the applicant's International patent publication no. WO 00/37766.

In certain circumstances, it is necessary to seal connections between lengths of expandable tubing, such as between sections of tubing forming a casing or liner string. However, it has been found difficult to obtain an adequate seal between the tubing sections post-expansion.

One reason for this is that a relative radial separation can occur between male and female (pin and box) connections by which adjacent tubing sections are coupled together, following expansion.

It is amongst the objects of embodiments of the present invention to obviate or mitigate the foregoing disadvantage.

SUMMARY OF THE INVENTION

According to a first aspect of the present invention, there is provided a method of sealing a connection between expandable tubulars, the method comprising the steps of:

connecting a first expandable tubular to a second expandable tubular with a seal located between radially overlapping portions of the tubulars; and configuring the seal to maintain sealing between the tubulars both pre and post expansion.

By configuring the seal to maintain sealing post-expansion, undesired leakage across the connection after expansion of the tubulars is prevented.

Preferably, the method further comprises expanding the first and second tubulars.

The step of configuring the seal to maintain sealing may comprise exerting a force on the seal sufficient to maintain sealing between the tubulars both pre and post expansion. The force may be exerted on the seal by compressing the seal either radially, axially or both radially and axially. The force may be exerted on the seal during connection or mating of the first and second expandable tubulars. This may be achieved by appropriate dimensioning or shaping of the first and second tubulars. For example, in one embodiment, the seal may be mounted on one of the tubulars and may define an uncompressed radial width (prior to connection of the tubulars). The tubulars may be dimensioned such that, when coupled together, a radial width of a space between the tubulars in which the seal is to be located is less than said uncompressed radial width of the seal, thereby compressing the seal. It will also be understood that there is a reduction in radial width of the seal post expansion, caused by diametric expansion of the seal. However, preferably, a post-expansion radial width of the space is less than a post expansion uncompressed radial width of the seal (a notional radial width of the seal when mounted on one of the tubulars, as described above, and expanded). Reference herein to a radial width of the seal is to a width in a radial direction of a wall of the seal.

The method may comprise coupling or mounting the seal on, in or to one of the first and second expandable tubulars. The seal may be located and supported against axial movement, and may, for example, be located in a channel or groove or otherwise recessed in or with respect to the respective tubular. Where the seal is located in a channel, groove or the like, the space may be defined between a base of the groove and a surface of the opposing tubular. Accordingly, the method may comprise dimensioning the space relative to the seal to ensure a large enough force is exerted on the seal to maintain sealing post expansion.

It will be understood that radial separation between the expandable tubulars may occur post expansion. This can occur in particular when using a roller expansion tool, which tends to cause an increase in the axial length of a tubular during expansion; an overlapping portion of a connected tubular experiences a different expansion mode and tends to contract in axial length, which can cause said portion to bend or bow outwardly at a location spaced from an end of the portion.

Furthermore, radial separation can occur due to a greater post-expansion elastic recovery of one of the tubulars relative to the other tubular. In particular, in the region of the overlapping tubular portions, an outer overlapping portion of one of the tubulars is expanded to a larger diameter than a radially inner portion. Where the tubulars are of similar materials, there can be a greater elastic recovery of the inner portion than the outer portion, after the expansion tool has passed through the tubulars.

Additionally, radial separation can occur due to "end effects", where an axial free end of a tubular experiences a greater degree of elastic recovery and tends to bend radially inwardly after an expansion tool has passed through the tubular.

The method may therefore comprise configuring the seal to accommodate any such radial separation between the first and second expandable tubulars (in particular between the radially overlapping portions of the tubulars) and also to accommodate any reduction in radial width of the seal.

The step of configuring the seal to maintain sealing may alternatively comprise exerting a force on the seal separately from the step of connecting the first and second tubulars together and, in embodiments of the invention, a mechanism may be provided for exerting a force on the seal. The mechanism may be moveable to exert a force on the seal and may be moveable in response to connection of the first and second tubulars together or may be separately actuated or operated.

In an alternative embodiment, the step of configuring the seal to maintain sealing may comprise locating a seal between said overlapping portions of the tubulars, the seal adapted to swell on exposure to an activating fluid. The seal may swell in the presence of a hydrocarbon based fluid such as an oil, water or water based fluid, or a combination thereof. It will be understood that such fluids are typically present in the downhole environment. The method may comprise selectively exposing the seal to the activating fluid. The seal may be initially isolated from the fluid, and the method may comprise exposing the seal to the fluid in a downhole environment. For example, the method may comprise running the tubulars into a borehole with the seal isolated from the activating fluid, and then exposing the seal to the activating fluid. The seal may be exposed in response to a predetermined pressure of activating fluid in a downhole environment, and the method may comprise providing an isolation member such as a disc or valve adapted to rupture or open in response to a determined pressure. Thus on experiencing a determined fluid pressure in the downhole environment, the isolation member may open or rupture, exposing the seal to the activating fluid, thereby causing the seal to swell to seal between the tubulars. In a further alternative, the method may further comprise exposing the seal during or on connection of the tubulars, or in a separate step, for example, by providing a mechanism which is actuatable to selectively expose the seal. In a still further alternative, where a seal is provided which is adapted to swell on exposure to a hydrocarbon based activating fluid, the seal may be open to the environment prior to location in the downhole environment (for example, on connection of the tubulars at surface), but as the seal only swells on exposure to the hydrocarbon based fluid, the seal only swells in the downhole environment.

The method may further comprise determining a location where the first and second expandable tubulars are likely to experience radial separation on expansion and locating the seal in said location. The method may comprise determining a degree of separation between said overlapping portions of the tubulars. The step of determining said location and/or degree of separation may comprise determining at least one parameter of the first and/or second expandable tubulars, the parameter selected from the group comprising: a material of the first and/or second tubular; a pre-expansion yield strength of the first and/or second tubular; Young's Modulus (E) of the first and/or second tubular; at least one dimension of the first and/or second tubular such as a pre-expansion length of overlap between the tubulars, relative pre-expansion diameters/wall thicknesses and thus relative spacing between the first and second tubulars, in a particular embodiment, a relative pre-expansion spacing between said overlapping portions of the first and second tubulars; a desired post-expansion diameter/wall thickness of the first and/or second tubular; anticipated work hardening of the tubulars; an anticipated or desired degree of axial extension or contraction in length of the first and/or second tubular; and loading or forces experienced by the tubulars during the expansion process.

The method may further comprise performing a simulation or analysis of expansion of the tubulars to determine a location of the seal and/or the degree of separation, and may comprise determining at least one, preferably a plurality of said parameters and performing the simulation based upon said selected parameter or parameters. The method may comprise carrying out a finite element analysis (FEA), by constructing a finite element model and applying simulated loading to the model.

There may be a plurality of seals and the method may comprise locating at least one seal on each of the first and second expandable tubulars, or locating a plurality of seals on one or both of the first and second expandable tubulars.

According to a second aspect of the present invention, there is provided expandable tubing comprising:

first and second expandable tubulars adapted to be coupled together; and a seal adapted to be located between radially overlapping portions of the first and second tubulars and to be configured to maintain sealing between the first and second tubulars both pre and post expansion.

The seal may be adapted to have a force exerted thereon sufficient to maintain sealing. The seal may be adapted to be compressed radially, axially or both radially and axially. The first and second tubulars may be adapted to exert a force on the seal during connection of the first and second expandable tubulars together. The tubulars may be dimensioned such that, when coupled together, a radial width of a space between the tubulars in which the seal is to be located is less than said uncompressed radial width of the seal, thereby compressing the seal. Alternatively, the tubing may comprise a mechanism for exerting a force on the seal either during connection of the first and second tubulars together or in a separate procedure, for example, following connection of the tubulars.

The seal may be configured to accommodate any radial separation between the first and second expandable tubulars, in particular between the radially overlapping portions of the tubulars, and also to accommodate any reduction in radial width of the seal.

Alternatively or additionally, the seal may be adapted to swell on exposure to an activating fluid. The seal may be adapted to swell in the presence of a hydrocarbon based fluid such as an oil, water or water based fluid, or a combination thereof. The seal may be adapted to be initially isolated from the fluid, and to subsequently be exposed to the fluid in a downhole environment. The seal may be exposed in response to a predetermined pressure of activating fluid in a downhole environment, and the tubing may comprise an isolation member such as a disc or valve adapted to rupture or open in response to a determined pressure. In a further alternative, the seal may be adapted to be exposed during or on connection of the tubulars, or in a separate step, for example, the tubing may comprise a mechanism which is actuatable to selectively expose the seal. In a still further alternative, where a seal is provided which is adapted to swell on exposure to a hydrocarbon based activating fluid, the seal may be exposed prior to location in the downhole environment.

One of the first and second tubulars may comprise a male connecting portion and the other a female connecting portion, the male and female connecting portions adapted to be connected together, and the seal may be adapted to be located between radially overlapping parts of said connecting portions. The seal may be mounted on or in or coupled to one of the first and second tubulars, and may be mounted, for example, in a channel or groove. The tubing may comprise a plurality of seals, and at least one seal may be mounted on or in or coupled to each of the first and second expandable tubulars, or one of the first and second tubulars may carry a plurality of seals.

The seal may comprise an O-ring, sleeve or the like.

According to a third aspect of the present invention, there is provided a method of sealing a connection between expandable tubulars, the method comprising the steps of:

providing first and second expandable tubulars, one of the first and second tubulars having a male connecting portion and the other a female connecting portion; and connecting and sealing the male and female connecting portions together.

The male and female connecting portions may therefore be configured such that the portions are sealed when connected together, and are thus automatically sealed on connection. The male and female connecting portions may be configured so as to be sealed post-expansion, but are preferably also sealed pre-expansion. The method may comprise exerting a mating force on the expandable tubulars during connection, the mating force sufficient to seal the connecting portions.

The male and female connecting portions may be sealed along an interface between the connecting portions. For example, the male and female connecting portions may be threaded and the method may comprise sealing between the respective threads of the male and female connecting portions.

The method may comprise providing a separate seal member or element such as a sealing sleeve, or a sealing material such as a paste or gel (in embodiments of the invention, a sealing thread dope) between the male and female connecting portions, in particular, between threads of the connecting portions. The seal member or the like may be compressed or squeezed on application of a mating force to the first and second expandable tubulars, such as during making up of the connection, and this may ensure sealing between the connecting portions.

Alternatively, the connecting portions may be adapted, for example, shaped or dimensioned, to self-seal on connection. For example, in embodiments of the invention, there may be a direct contact such as a metal to metal seal between the male and female connecting portions. Where the male and female connecting portions are threaded, threads of the respective portions may be shaped or otherwise formed to provide a seal on connection. In particular, the threads may be shaped to maintain sealing post-expansion and may, for example, be box or wedge shaped (such as where the male and female connecting portions are coupled together in a tapered fit) such that at least one, optionally both, of the leading and trailing thread flanks of the threads on one of the tubulars are in sealing contact with the cooperating trailing and leading thread flanks, respectively, on the other tubular, and said cooperating thread flanks may be perpendicular to axes of the tubulars. Thus any separation between the connecting portions during expansion does not cause any loss of sealing.

The method may comprise providing the first and second expandable tubulars of materials having different yield strengths and/or Young's Modulus. In a particular embodiment, the method may comprise forming the female connecting portion of a material having a higher yield strength and/or a lower Young's Modulus than the male connecting portion. This ensures that, on expansion, there is a relatively greater elastic recovery of the female portion relative to the male portion, maintaining a good connection and thus sealing between the male and female connecting portions and preventing or minimising any radial separation between the portions.

According to a fourth aspect of the present invention, there is provided expandable tubing comprising first and second expandable tubulars, one of the first and second tubulars having a male connecting portion and the other a female connecting portion, the male and female connecting portions adapted to be connected and sealed together.

Preferably, the male and female connecting portions are threaded and the threads may be formed or shaped to be sealed on connecting the portions together. In embodiments of the invention, the threads may be shaped to provide an interference sealing fit on connection and so as to maintain an interference seal fit post-expansion. The threads may be box shaped, wedge shaped, tapered or the like so as to allow for a degree of radial separation on expansion whilst maintaining an interference fit between the threads, such that any separation of the connection portions does not cause loss of sealing. The first and second tubulars may be coupled together such that at least one, optionally both, of the leading and trailing thread flanks of the threads on one of the tubulars are in sealing contact with the cooperating trailing and leading thread flanks, respectively, on the other tubular, and said cooperating thread flanks may be perpendicular to axes of the tubulars.

The male and female connecting portions may alternatively be adapted to be sealed relative to each other by a separate seal element, member or the like such as a seal sleeve, or by a material such as a paste or gel (for example, thread dope). The seal element, member or the like may be located between the connecting portions such as between threads of the portions.

Preferably, the female connecting portion is of a material having a higher yield strength and/or lower Young's Modulus than the male portion, ensuring sealing is maintained post-expansion, as described above. For example, the female portion may be of a Titanium alloy, whereas the male portion may be of a steel.

According to a fifth aspect of the present invention, there is provided a method of sealing a connection between expandable tubulars, the method comprising the steps of:

connecting a first expandable tubular to a second expandable tubular;

expanding the first and second expandable tubulars; and permitting post expansion elastic recovery of at least a portion of one of the first and second tubulars relative to the other one of the first and second tubulars to seal the connection.

Preferably, the method comprises permitting recovery of said portion into sealing engagement with said other tubular.

The post-expansion recovery which takes place may be a relative radial contraction between said portion and said other tubular, and may be due to end effects experienced by said portion on expansion. The method may comprise selecting one or more parameter of the first and/or second expandable tubular to achieve a desired elastic recovery, the parameter selected from the group defined above.

The seal may additionally or alternatively be formed or enhanced by end effects experienced by said portion of the tubular.

Alternatively or additionally, the method may comprise providing first and second expandable tubulars of different yield strengths and/or Young's modulus, which may be achieved by selecting or forming the tubulars of different materials. In this fashion there may be a relative elastic recovery in said portion post-expansion.

Said portion may be adapted to elastically recover into contact with said other tubular to seal the connection. Alternatively or additionally, a separate seal member or element may be provided located between radially overlapping portions of the first and second expandable tubulars for sealing the connection post-expansion.

According to a sixth aspect of the present invention, there is provided expandable tubing comprising first and second expandable tubulars adapted to be coupled together and expanded, and whereby post expansion elastic recovery of at least a portion of one of the first and second tubulars into engagement with the other one of the first and second tubulars is adapted to seal the connection.

One of the first and second tubulars may have a male connecting portion and the other a female connecting portion, the male and female connecting portions adapted to be connected together. At least part of one of the first and second expandable tubulars, preferably the female connecting portion, may be adapted to overlap the other tubular, preferably the male connecting portion. This provides an overlap between the first and second expandable tubulars, and the overlap may form said portion. The dimensions of the overlap may be selected to provide a desired post-expansion elastic recovery, or the elastic recovery may be dependent on additional or alternative parameters selected from the group defined above.

In an embodiment of the invention, the first and second expandable tubulars, in particular the male and female connecting portions, may be of different yield strengths and/or Young's Modulus. This may ensure that residual stresses post-expansion provide a desired seal with the female connecting portion.

The expandable tubing may further comprise a seal element or member and said portion may be adapted to exert a force on the seal on post-expansion elastic recovery. Additionally or alternatively, post-expansion elastic recovery of said portion may provide a contact seal between said portion and said other tubular.

According to a seventh aspect of the present invention, there is provided a method of sealing a connection between expandable tubulars, the method comprising the steps of:

providing a first expandable tubular and a second expandable tubular, one of the first and second tubulars having a male connecting portion and the other one of the first and second tubulars having a female connecting portion;

connecting the male and female connecting portions together;

expanding the first and second tubulars; and permitting a relative movement between the male and female connecting portions, to bring said portions into sealing engagement.

During expansion of an expandable tubular, particularly when using a rotary expansion tool, the tubular may undergo an axial extension. Due to the different expansion mode, a second connected tubular can undergo axial contraction, as described above. By permitting and planning for a relative movement between the male and female connecting portions of the invention, this movement can be used to bring selected parts of the portions into sealing engagement. The permitted relative movement is preferably a relative axial movement or translation of one or both of the male and female connecting portions.

The seal may be achieved by permitting a direct sealing engagement or contact between the male and female connecting portions, which may be between selected parts of the portions such as cooperating ends, faces, shoulders or the like, such engagement providing a seal. Additionally or alternatively, a separate seal member, element or other seal material may be provided between the connecting portions, such as between ends, shoulders, faces or the like of the respective male and female connecting portions.

The first and second expandable tubulars may be adapted to be sealed both pre and post-expansion, with an enhanced sealing effect post-expansion due to said permitted relative movement.

According to an eighth aspect of the present invention, there is provided expandable tubing comprising:

first and second expandable tubulars, one of the first and second tubulars having a male connecting portion and the other a female connecting portion, the connecting portions adapted to be coupled together and expanded and whereby a relative movement between the male and female connecting portions is permitted on expansion, to bring said portions into sealing engagement.

The male and female connecting potions may be threaded and axially adjacent threads may overlap in a radial direction when the connecting portions are coupled together. This may ensure integrity of the expandable tubing.

It will be understood that in further aspects of the present invention, there may be provided a method of sealing a connection between expandable tubulars and expandable tubing combining the features of one or more of the above described aspects, or other features, of the present invention.

BRIEF DESCRIPTION OF THE DRAWINGS

Embodiments of the present invention will now be described, by way of example only, with reference to the accompanying drawings, in which.

DETAILED DESCRIPTION OF DRAWINGS

Figure 1:
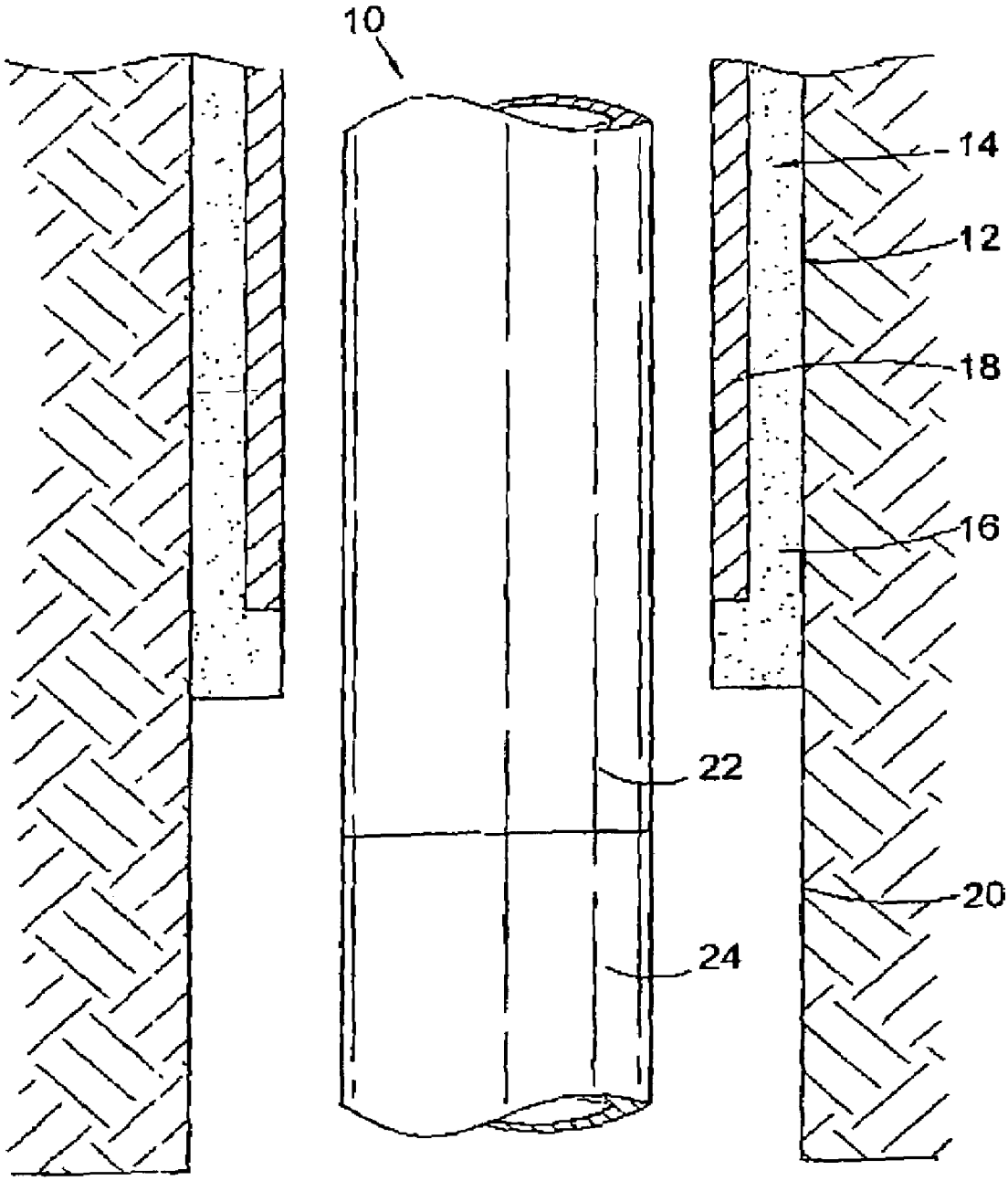
FIG. 1 is a view of expandable tubing in accordance with an embodiment of the present invention, in the form of an expandable liner, the liner shown located in a casing-lined borehole prior to expansion of the liner.

Turning firstly to FIG. 1, there is shown expandable tubing in accordance with an embodiment of the present invention, in the form of an expandable liner indicated generally by reference numeral 10. The liner 10 is shown located in a borehole 12, which has been lined with a casing 14 and cemented at 16, in a convention fashion. The liner 10 extends from a casing shoe 18 (the lowermost or deepest section of casing 14 in the borehole 12) and into an unlined, open hole portion 20 of the borehole 12. The liner 10 is to be used to line the open hole portion 20 to provide access to a hydrocarbon producing formation (not shown) spaced from the casing shoe 18. Also, the liner 10 is shown in FIG. 1 prior to expansion using an expansion cone or mandrel, a roller expansion tool such as that disclosed in the applicant's International patent publication No. WO 00/37766, or a combination thereof.

The expandable liner 10 is made up of a series of expandable tubulars or tubing sections coupled together. In FIG. 1, first and second expandable tubulars 22, 24 are shown coupled together, however it will be understood that the expandable liner 10 comprises a large number of such tubulars coupled together.

Figure 2:
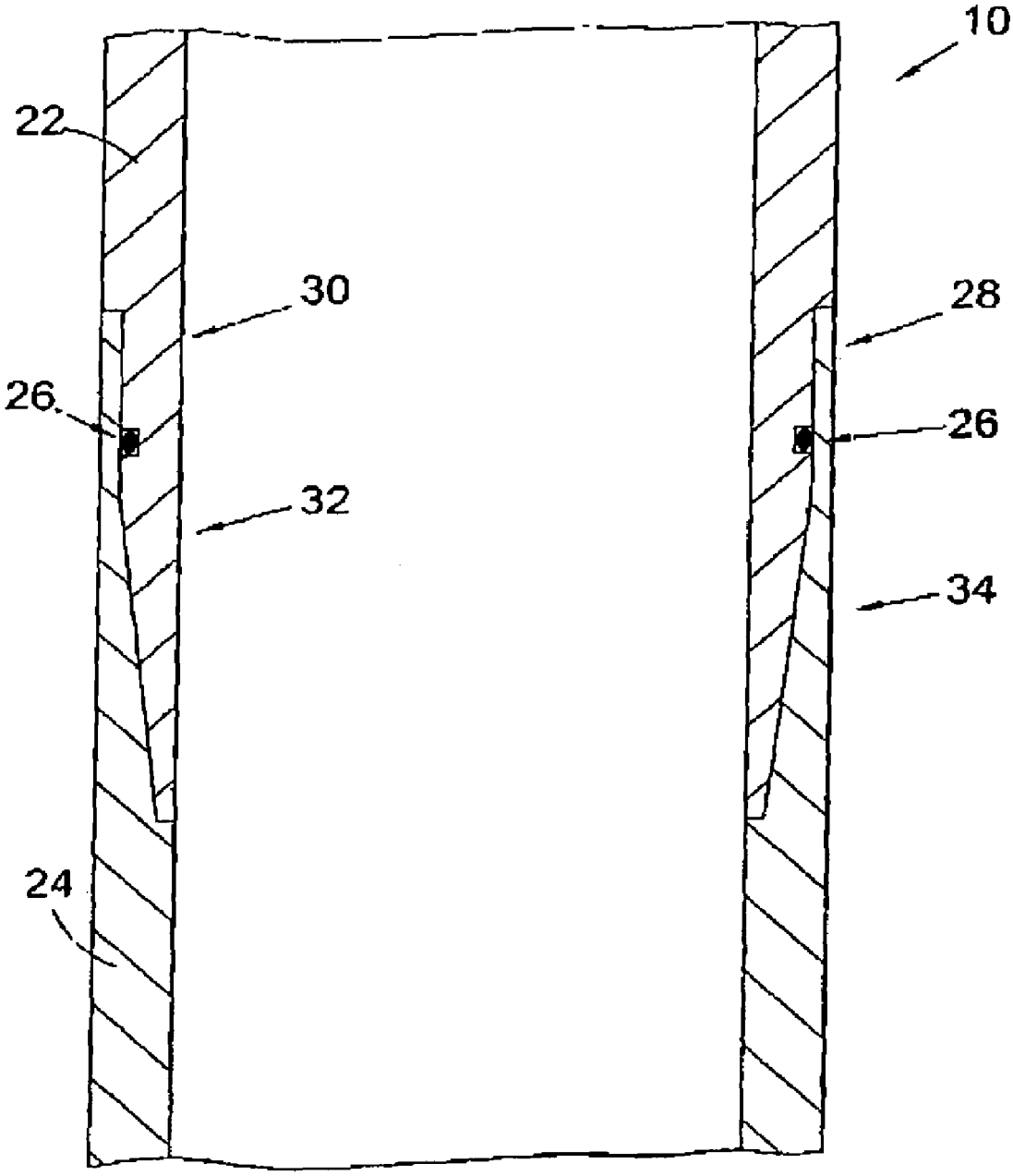
FIG. 2 is an enlarged, longitudinal cross-sectional view of part of the liner of FIG. 1.

Turning now to FIG. 2, there is shown an enlarged, longitudinal cross-sectional view of part of the liner 10 of FIG. 1. The first and second expandable tubulars 22, 24 take the form of sections of liner and are coupled together with an O-ring seal 26 located between radially overlapping portions 28, 30 of the liner sections 22, 24, respectively. The liner section 22 comprises a male connecting portion in the form of a pin 32 and the second liner section 24 a female connecting portion in the form of a box 34, the pin and box 32, 34 coupled together in a conventional fashion. It will be understood that the liner sections 22, 24 and the remaining liner sections forming the liner 10 each comprise a pin and a box at opposite ends thereof, for coupling the liner sections together end to end to form the liner string.

Figure 3:
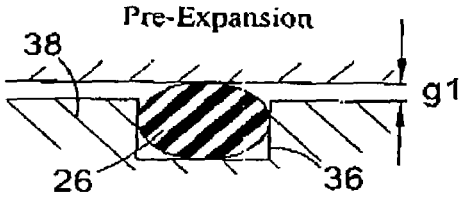
FIGS. 3 and 4 are schematic sectional views of seals forming part of the liner of FIG. 1, shown before and after expansion, respectively.

The dimensions of the liner sections 22, 24 and in particular the dimensions of the pin and box 32, 34 are selected such that a force is exerted on the seal 26 when the pin and box are mated as shown in FIG. 2. The seal 26 is thus pre-loaded with a force sufficient to seal the pin 32 relative to the box 34 prior to expansion of the liner 10. The seal 26 is shown in more detail both before and after expansion in the views of FIGS. 3 and 4, respectively, and it will be noted that the seal 26 is located and axially restrained in a circumferential groove 36 in a wall 38 of the pin 32. The pin 32 and box 34 are dimensioned such that a radial gap g1 exists between the overlapping portions 28, 30 of the pin and box. The gap g1 (FIG. 3) is sized to ensure that the seal 26 is compressed on connecting the pin and box 32, 34 together, to seal between the overlapping portions 28, 30. On expansion of the liner 10, the radial gap g1 increases to a gap g2. This is due to the pin and box 32, 34 experiencing different expansion modes, as will be described below. However, the pre-expansion load applied to the seal 26 during connection of the pin 32 to the box 34 is sufficiently large to ensure that the seal 26 maintains sealing between the pin and box 32, 34. Thus sealing is maintained even following an increase in the gap to the dimension g2.

Other factors affecting the pre and post-expansion loading on the seal 26 include: a material of the first and/or second tubular; a pre-expansion yield strength of the first and/or second tubular; Young's Modulus (E) of the first and/or second tubular; at least one dimension of the first and/or second tubular such as a pre-expansion length of overlap between the tubulars, relative pre-expansion diameters/wall thicknesses and thus relative spacing between the first and second tubulars, in a particular embodiment, a relative pre-expansion spacing between said overlapping portions of the first and second tubulars; a desired post-expansion diameter/wall thickness of the first and/or second tubular; anticipated work hardening of the tubulars; an anticipated or desired degree of axial extension or contraction in length of the first and/or second tubular; and loading or forces experienced by the tubulars during the expansion process.

Figure 4:
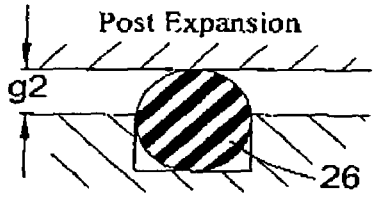
Figure 5:
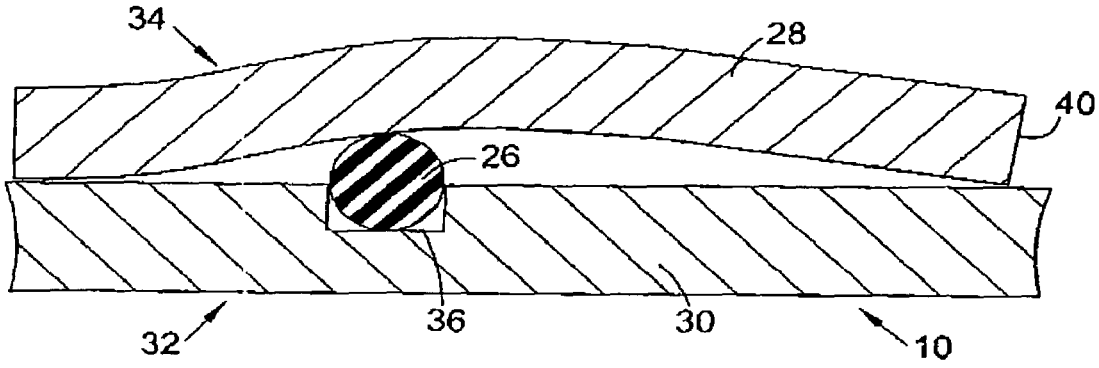
FIG. 5 is a schematic sectional view of part of the liner of FIG. 1 following expansion and showing the seal in the expanded position of FIG. 4.

FIG. 5 is a schematic cross-sectional view of part of the liner 10 of FIG. 2 post-expansion, with the seal 26 in the expanded position of FIG. 4. As shown in FIG. 5, on expansion of the liner 10, there is a tendency for the box 34 to bend or deform in a direction towards an end 40 of the box 34, causing a radial separation between the overlapping portions 28, 30, which is illustrated in exaggerated fashion in the figure. This is due to the expansion forces experienced by the liner 10. In particular, when the liner 10 is expanded using a roller expansion tool, such as that disclosed in the applicant's International patent publication No. WO 00/37766, the liner sections 22, 24 and thus the pin 32 are expanded. During this process, it has been found that the liner sections 22, 24 and thus the pin 32 tend to increase in axial length. This is due at least in part to the roller expansion tool tending to thin the wall of the liner sections 22, 24.

In contrast, the box 34 experiences a different expansion mode, being expanded by radially outward movement of the pin 32, which tends to axially contract in length. Accordingly, there is a relative axial movement of the overlapping portion 28 of the box 34 relative to the overlapping portion 30 of the pin 32 during expansion of the liner 10, causing the deformation illustrated in exaggerated fashion in FIG. 5.

Radial separation can also occur where the pin 32 and box 34 are of similar materials. This is because the outer overlapping portion 28 of the box 34 is expanded to a larger diameter than the radially inner portion 30 of the pin 32, and there can be a greater post-expansion elastic recovery of the portion 30 of the pin 32 relative to the portion 28 of the box 34. Thus the effect may also be present where the liner 10 is expanded using a cone or mandrel or combination of cone and roller expansion tool.

By determining the extent of the bending caused by these effects and locating the seal 26 accordingly, sealing between the pin and box 32, 34 can be maintained post-expansion.

The end 40 of the box 34 also experiences "end effects", tending to cause the box end 40 to elastically recover to a greater degree than a remainder of the liner section 24, after the expansion tool has passed through the section. The end effect can be utilised to enhance sealing between the pin and box 32, 34, as the recovery of the box end 40 provides a seal where it contacts the pin 32, and a seal may optionally be located at the pin end between the pin and box 32, 34.

The above described method may further comprise performing a simulation or analysis of expansion of the liner sections 22, 24 to determine an appropriate location for the seal 26 and/or the degree of separation, comprising determining a plurality of the parameters described above and performing the simulation based upon the selected parameters. This may be achieved by carrying out a finite element analysis (FEA), by constructing a finite element model and applying simulated loading to the model.

Figure 6:
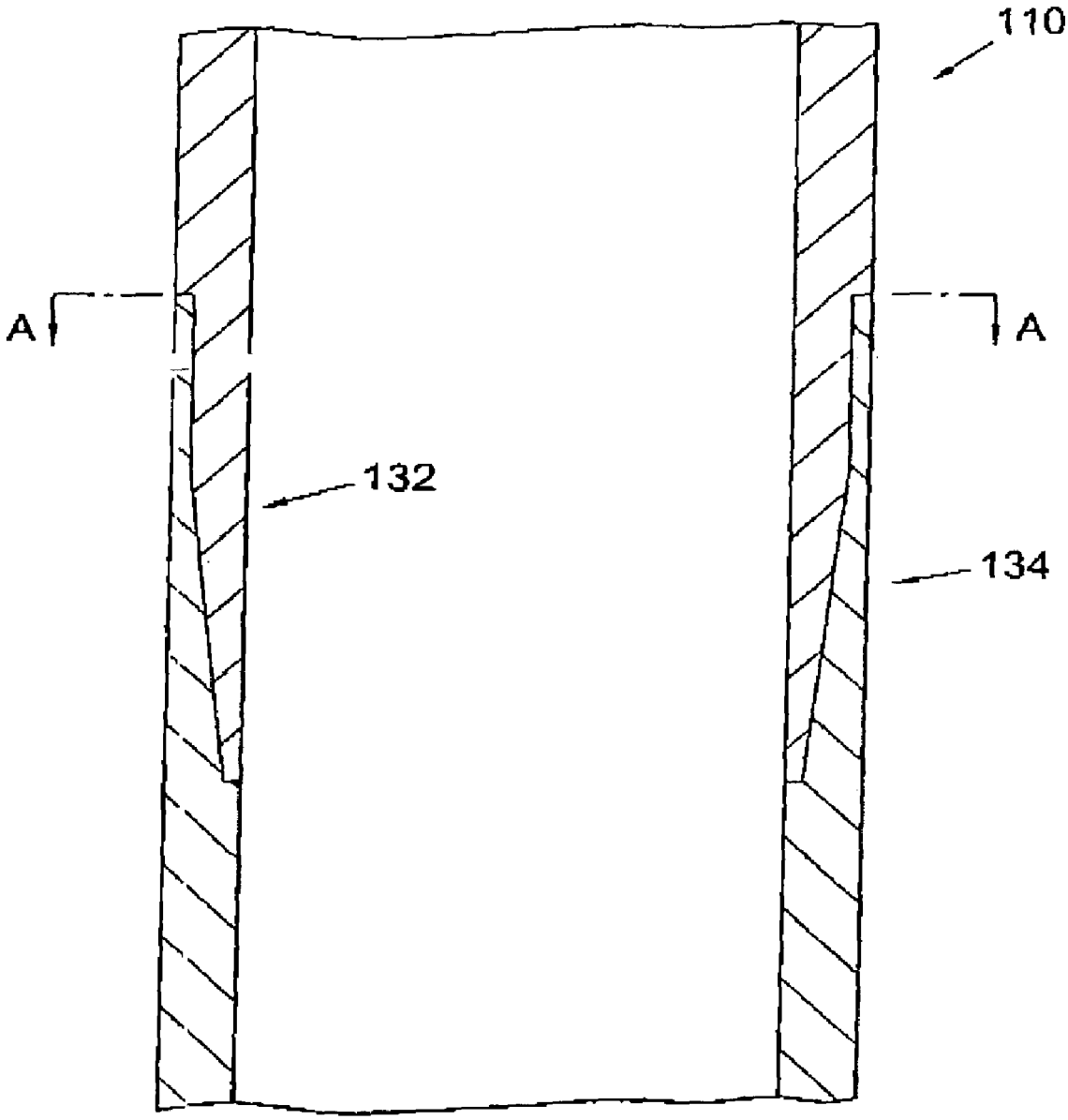
FIG. 6 is a longitudinal cross-sectional view of part of an expandable tubing in accordance with an alternative embodiment of the present invention, in the form of an alternative expandable liner.

Turning now to FIG. 6, there is shown a longitudinal cross-sectional view of part of an expandable tubing in accordance with an alternative embodiment of the present invention, in the form of an alternative expandable liner 110. The liner 110 is similar to the liner 10 of FIGS. 1-5, and like components share the same reference numerals incremented by 100.

Figure 7:
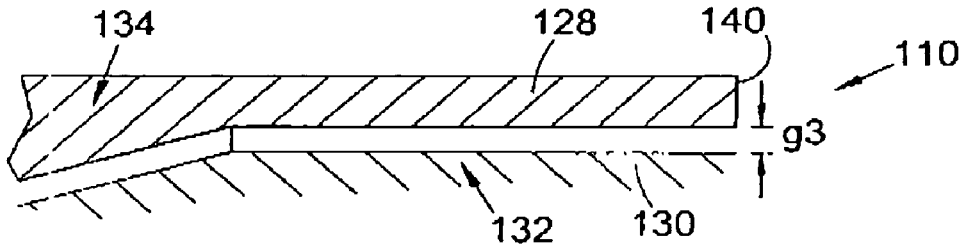
FIGS. 7 and 8 are enlarged views of part of the liner of FIG. 6 shown before and after expansion, respectively.
Figure 8:
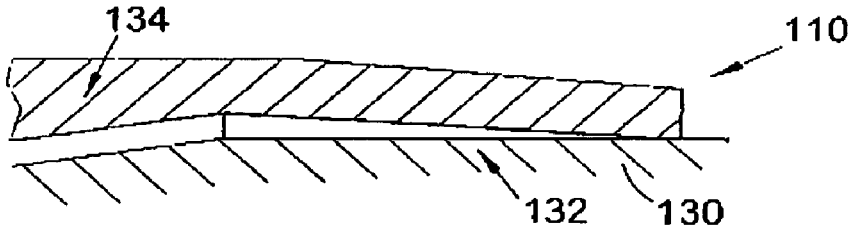

The liner 110 is provided without a seal such as the seal 26 of the liner 10, and bending effects similar to that described in relation to the liner 10 of FIGS. 1 to 5 are utilised to achieve a seal between a pin 132 and a box 134 of the liner 110 post-expansion. FIGS. 7 and 8 are schematic cross-sectional views of part of the liner 110 (left half of FIG. 6) shown before and after expansion, respectively. It will be noted that the combination of elongation of the pin 132 and axial contraction of the box 134 causes the box end 140 to close a gap g3 which exists between the overlapping portions 130, 128 of the pin and box 132, 134 to provide a post-expansion sealing effect. Sealing may be achieved through a simple metal to metal contact between the overlapping portions 128, 130, which is preferred in the high temperature, high pressure downhole environment, but a seal member (not shown) such as an O-ring or seal sleeve may be located between the overlapping portions 128, 130 in the region of the box end 140. The seal is thus compressed or squeezed between the overlapping portions 128, 130 on expansion. The sealing effect may be enhanced by end effects experienced by the box end 140, as described above.

Figure 9:
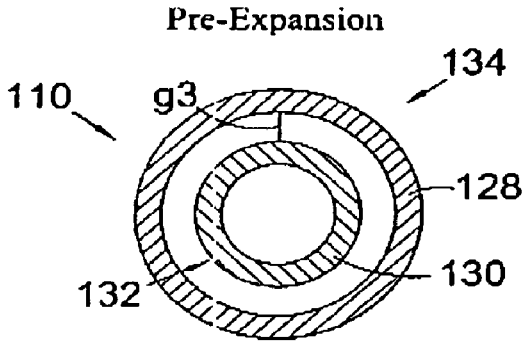
FIGS. 9 and 10 are views of part of the liner of FIG. 6 before and after expansion, respectively, taken along line A-A of FIG. 6.
Figure 10:
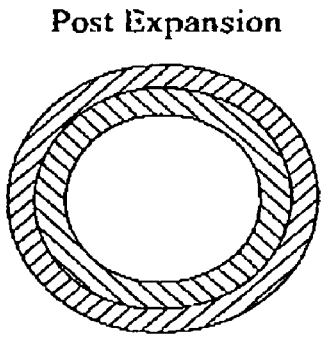

Turning now to FIGS. 9 and 10, there are shown schematic cross-sectional views of part of the liner 110 of FIG. 6 taken along line A-A, and shown both before and after expansion. It will be understood that the views of FIGS. 9 and 10 are schematic and that relative dimensions have been exaggerated for illustration purposes. Furthermore, the features of the liner 110 described with reference to FIGS. 9 and 10 may form part of an embodiment of the invention in combination with the features of FIGS. 7 and 8, or taken separately.

FIG. 9 illustrates the pin 132 and box 134 and the overlapping portions 128, 130 with the gap g3 between the overlapping portions. In the embodiment of FIGS. 9 and 10, the pin 132 is made from a material having a lower yield strength and/or a higher Young's Modulus (E) than the box 134. For example, the pin 132 may be of a steel and the box 134 of a titanium alloy. In this fashion, on expansion of the liner 110 as illustrated in FIG. 10, residual stresses in the pin and box 132, 134 are such that there is a differential hoop stress between the pin and box 132, 134. Accordingly, there tends to be a greater degree of elastic recovery of the box 134 than the pin 132. This brings the box 134, in particular the overlapping portion 128, into sealing engagement with the pin 132, in particular the overlapping portion 130. The sealing effect may be enhanced using a seal member located between the overlapping portions, as described above.

Figure 11:
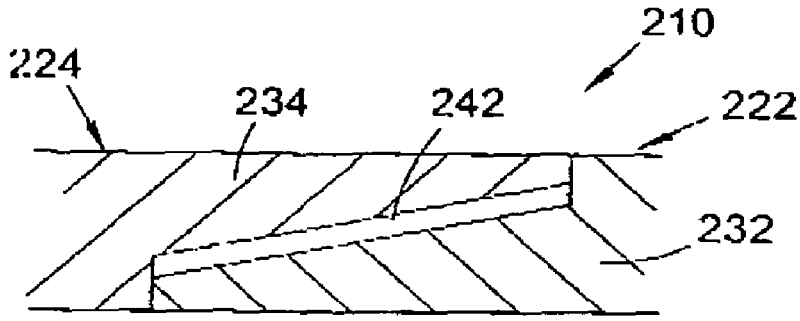
FIG. 11 is a cross-sectional view of part of a liner in accordance with a further alternative embodiment of the present invention.

Turning now to FIG. 11, there is shown a schematic cross-sectional view of part of a liner 210 in accordance with a further alternative embodiment of the present invention. Like components of the liner 210 with the liner 10 of FIGS. 1 to 5 share the same reference numerals, incremented by 200.

FIG. 11 shows a pin 232 and a box 234 by which liner sections 222, 224 are coupled together. The pin and box 232, 234 may be threaded in a conventional fashion and with a seal member 242, such as an elastomeric sleeve clamped between the threads of the pin and box 232, 234. Alternatively, a seal material such as a paste or gel, in particular a sealing thread dope (dope is used to ease make-up of or connection of a pin to a box) may be provided with a sealing effect, to seal between the threads of the pin and box 232, 234. It will be understood that, to ensure integrity of the connection between the liner sections 222, sequential turns of the threads of the pin and box 232, 234 may overlap in a radial direction, and that any clearance between the threads is taken up by the seal member 242.

To ensure that a seal is maintained post-expansion, the threads on the pin and box 232, 234 are shaped so as to allow a degree of radial separation between the pin and box 232, 234 whilst maintaining sealing contact between the threads. This may be achieved by providing the pin and box 232, 234 with box shaped threads or, where the pin and box are tapered, with wedge shaped threads, where at least some flanks of the threads are perpendicular to a main, longitudinal axis of the liner 210. For example, trailing or load flanks of the pin 232 threads (when coupled pin-down to the box) and cooperating leading or stab-in flanks of the box 234 threads may be perpendicular to the liner axis, and/or vice versa. In this fashion, sealing contact between threads on the pin and box 232, 234 is maintained even where there is a separation on expansion.

Figure 12:
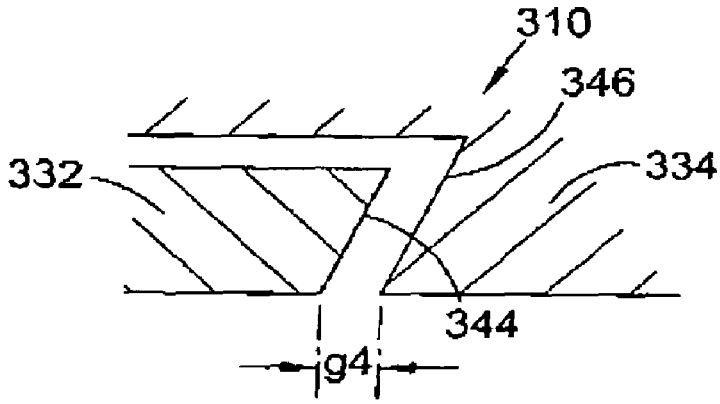
FIGS. 12 and 13 are shown cross-sectional views of part of a liner in accordance with a further alternative embodiment of the present invention.
Figure 13:
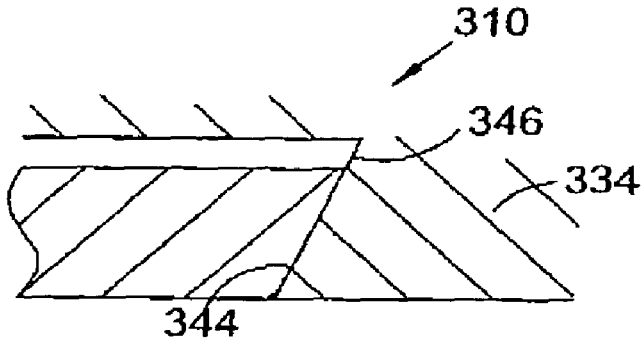

Turning now to FIGS. 12 and 13, there are shown schematic cross-sectional views of part of a liner 310 in accordance with an alternative embodiment of the present invention, the liner 310 shown before and after expansion, respectively. Like components of the liner 310 with the liner 10 of FIGS. 1 to 5 share the same reference numerals, incremented by 300.

FIG. 12 shows a connection between a box 334 and a pin 332, with a leading end 344 adjacent a shoulder 346 on the box 334. It will be understood that the view of the connection between the pin 332 and box 334 is similar to the right half of the liner 10 shown in FIG. 2, likewise illustrated in a pin-down position.

Before expansion, there is an axial gap g4 between the leading end 344 of the pin 332 and the shoulder 346 on the box 334. However, it will be understood that the end 344 and shoulder 346 may be in contact. On expansion and as described above, the pin 332 of the liner 310 tends to extend in axial length, as described above. This brings the pin leading end 344 into sealing engagement (or into enhanced engagement) with the box shoulder 346, as illustrated in FIG. 13. Sealing may be achieved through direct metal to metal sealing contact between the pin leading end 344 and the box shoulder 346, or a seal member, element or material (not shown) may be provided between the pin leading end 344 and box shoulder 346. It will be noted that the pin leading end 344 and shoulder 346 of the box 334 are angled or undercut, so as to resist separation of the pin and box 332, 334 on expansion.

It will be understood that the features of the liners 10, 110, 210 and 310 described above may be provided separately or in combination. For example, in a further alternative embodiment of the present invention, an expandable liner may be provided combining the features of all of the liners 10, 110, 210 and 310.

Various modifications may be made to the foregoing within the scope of the present invention.

For example, the step of exerting a force on the seal may be separate from the step of connecting the first and second tubulars together, and in embodiments of the invention, a mechanism may be provided for exerting a force on the seal. The mechanism may be moveable to exert a force on the seal and may be moveable in response to connection of the first and second tubulars together or may be separately actuated or operated.

The step of exerting a force on the seal may comprise compressing the seal axially or both radially and axially.

There may be a plurality of seals and the method may comprise locating at least one seal on each of the first and second expandable tubulars, or locating a plurality of seals on one or both of the first and second expandable tubulars.

The step of configuring the seal to maintain sealing may comprise locating a seal between said overlapping portions of the tubulars, the seal adapted to swell on exposure to an activating fluid. The seal may swell in the presence of a hydrocarbon based fluid such as an oil, water or water based fluid, or a combination thereof. The method may comprise selectively exposing the seal to the activating fluid. The seal may be initially isolated from the fluid, and the method may comprise exposing the seal to the fluid in a downhole environment. For example, the method may comprise running the tubulars into a borehole with the seal isolated from the activating fluid, and then exposing the seal to the activating fluid. The seal may be exposed in response to a predetermined pressure of activating fluid in a downhole environment, and the method may comprise providing an isolation member such as a disc or valve adapted to rupture or open in response to a determined pressure. In a further alternative, the method may further comprise exposing the seal during or on connection of the tubulars, or in a separate step, for example, by providing a mechanism which is actuatable to selectively expose the seal. In a still further alternative, where a seal is provided which, is adapted to swell on exposure to a hydrocarbon based activating fluid, the seal may be open to the environment prior to location in the downhole environment.

The invention claimed is:

1. Expandable tubing comprising:

first and second expandable tubulars coupled together with a gap between the tubulars in a pre expansion position; and a seal located between radially overlapping portions of the first and second tubulars in a post expansion position in which the gap is increased relative to the pre expansion position, wherein the seal maintains sealing between the first and second tubulars in both pre and post expansion positions of the tubulars.

2. Expandable tubing as claimed in claim 1, wherein the seal is adapted to be configured to maintain sealing by exertion of a force on the seal.

3. Expandable tubing as claimed in claim 2, wherein the seal is adapted to be compressed radially.

4. Expandable tubing as claimed in claim 2, wherein the seal is adapted to be compressed axially.

5. Expandable tubing as claimed in claim 1, wherein the first and second tubulars are adapted to compress the seal on coupling to maintain sealing between the tubulars.

6. Expandable tubing as claimed in claim 5, wherein the tubulars are dimensioned such that, when coupled together, a pre-expansion radial width of a space between the tubulars in which the seal is adapted to be located is less than an uncompressed radial width of the seal.

7. Expandable tubing as claimed in claim 5, wherein the tubulars are dimensioned such that, when coupled together, a post-expansion radial width of a space between the tubular in which the seal is adapted to be located is less than a radial width of the seal following expansion.

8. Expandable tubing as claimed in claim 1, wherein the tubing comprises a mechanism for exerting a force on the seal during coupling of the first and second tubulars to maintain sealing between the tubulars.

9. Expandable tubing as claimed in claim 1, wherein the tubing comprises a mechanism for exerting a force on the seal subsequent to coupling of the first and second tubulars to maintain sealing between the tubulars.

10. Expandable tubing as claimed in claim 1, wherein the seal is adapted to swell on exposure to an activating fluid.

11. Expandable tubing as claimed in claim 10, wherein the seal is adapted to swell on exposure to a hydrocarbonaceous activating fluid.

12. Expandable tubing as claimed in claim 10, wherein the seal is adapted to swell on exposure to water.

13. Expandable tubing as claimed in claim 10, wherein the tubing is arranged to initially isolate the seal from activating fluid, and to subsequently expose the seal to the activating fluid in a downhole environment.

14. Expandable tubing as claimed in claim 13, wherein the tubing is arranged to expose the seal in response to a predetermined fluid pressure in a downhole environment.

15. Expandable tubing as claimed in claim 1, wherein one of the first and second tubulars comprises a male connecting portion and the other a female connecting portion, the male and female connecting portions adapted to be connected together with the seal located between radially overlapping parts of said connecting portions.

16. Expandable tubing as claimed in claim 1, wherein the seal is mounted on one of the first and second tubulars.

17. Expandable tubing as claimed in claim 1, wherein the seal is located in a channel which restrains the seal against axial movement.

18. A method of sealing a connection between expandable tubulars, the method comprising the steps of:

connecting a first expandable tubular to a second expandable tubular with a seal located between radially overlapping portions of the tubulars;

determining a location where the first and second expandable tubulars are likely to experience increased radial separation on expansion and locating the seal in said location; and configuring the seal to maintain sealing between the tubulars both pre and post expansion.

19. A method as claimed in claim 18, comprising expanding the first and second tubulars to produce the increased radial separation.

20. A method as claimed in claim 18, comprising configuring the seal by exerting a force on the seal sufficient to maintain sealing between the tubulars both pre and post expansion.

21. A method as claimed in claim 20, comprising configuring the seal by compressing the seal.

22. A method as claimed in claim 21, comprising configuring the seal by radially compressing the seal.

23. A method as claimed in claim 21, comprising configuring the seal by axially compressing the seal.

24. A method as claimed in claim 21, comprising configuring the seal by radially and axially compressing the seal.

25. A method as claimed in claim 20, comprising configuring the seal by exerting a force on the seal on connection of the first and second expandable tubulars.

26. A method as claimed in claim 25, comprising configuring the seal by dimensioning the first and second tubulars to compress the seal on connection of the tubulars.

27. A method as claimed in claim 25, comprising configuring the seal by dimensioning the tubulars such that a pre-expansion radial width of a space between the tubulars in which the seal is located is less than a pre-expansion uncompressed radial width of the seal.

28. A method as claimed in claim 25, comprising configuring the seal by dimensioning the tubulars such that a post-expansion radial width of a space between the tubulars in which the seal is located is less than a radial width of the seal following expansion.

29. A method as claimed in claim 18, comprising configuring the seal by exerting a force on the seal sufficient to maintain sealing between the tubulars subsequent to connection of the first and second tubulars.

30. A method as claimed in claim 18, comprising mounting the seal on one of the first and second expandable tubulars.

31. A method as claimed in claim 18, comprising supporting the seal against axial movement.

32. A method as claimed in claim 18, comprising configuring the seal to maintain sealing by locating a seal adapted to swell on exposure to an activating fluid between said overlapping portions of the tubulars.

33. A method as claimed in claim 32, comprising selectively exposing the seal to an activating fluid.

34. A method as claimed in claim 33, comprising initially isolating the seal from the activating fluid, locating the tubulars in a downhole environment and then exposing the seal to the activating fluid.

35. A method as claimed in claim 18, comprising determining a location where the first and second expandable tubulars are likely to experience radial separation on expansion and locating the seal in said location.

36. A method as claimed in claim 18, comprising determining an anticipated degree of post-expansion separation between said overlapping portions of the tubulars.

37. A method as claimed in claim 35, comprising determining at least one parameter of the first and/or second expandable tubulars.

38. A method as claimed in claim 37, comprising selecting the parameter from the group consisting of: a material of at least one of the first and second tubulars; a pre-expansion yield strength of at least one of the first and second tubulars; Young's Modulus (E) of at least one of the first and second tubulars; anticipated work hardening of the tubulars; an anticipated degree of axial change in length of at least one of the first and second tubulars; and forces experienced by the tubulars during the expansion process.

39. A method as claimed in claim 37, wherein the parameter comprises at least one dimension of at least one of the first and second tubulars, said dimension selected from the group consisting of: a pre-expansion length of overlap between the tubulars; relative pre-expansion diameters and wall thicknesses of the tubulars; a relative pre-expansion spacing between said overlapping portions of the tubulars; and a desired post-expansion diameter and wall thickness of at least one of the first and second tubulars.

40. A method as claimed in claim 35, comprising performing a simulation of expansion of the tubulars.

41. A method as claimed in claim 38, comprising determining a plurality of said parameters and performing a simulation of expansion of the tubulars based upon said selected parameters.

42. A method as claimed in claim 40, comprising carrying out a finite element analysis (FEA).

43. A method of sealing a connection between expandable tubulars, the method comprising the steps of:

providing first and second expandable tubulars, one of the first and second tubulars having a male connecting portion and the other a female connecting portion;

connecting and sealing the male and female connecting portions together, wherein the sealing includes locating a seal member between the male and female connecting portions;

expanding the first and second tubulars, the expanding resulting in a first gap greater than a second gap defined between the first and second expandable tubulars pre-expansion, wherein the seal member forms a seal in both the first and second gaps.

44. A method as claimed in claim 43, comprising exerting a mating force on the expandable tubulars during connection sufficient to seal the connecting portions.

45. A method as claimed in claim 43, further comprising providing threaded male and female connecting portions and sealing between respective threads of the male and female connecting portions.

46. A method as claimed in claim 43, comprising shaping the connecting portions to self-seal on connection.

47. A method as claimed in claim 46, comprising forming a metal to metal seal between the male and female connecting portions.

48. A method as claimed in claim 46, comprising providing threaded male and female connecting portions and shaping the threads to provide a seal on connection.

49. A method as claimed in claim 43, comprising providing at least parts of the first and second expandable tubulars of materials having different yield strengths.

50. A method as claimed in claim 43, comprising providing at least parts of the first and second expandable tubulars of materials each having a different Young's Modulus.

51. A method as claimed in claim 43, comprising forming the female connecting portion of a material having at least one of a higher yield strength and a lower Young's Modulus than the male connecting portion.

* * * * *